US007690443B2

(12) United States Patent
Brunet et al.

(10) Patent No.: US 7,690,443 B2
(45) Date of Patent: Apr. 6, 2010

(54) APPARATUS, SYSTEM, AND METHOD FOR CASING HOLE FORMATION IN RADIAL DRILLING OPERATIONS

(76) Inventors: Charles Brunet, 1017 Nantucket, Houston, TX (US) 77057; Michel Bouchard, 1703-605-13th Avenue SW., Calgary, Alberta (CA) 12R CK5

( * ) Notice: Subject to any disclaimer, the term of this patent is extended or adjusted under 35 U.S.C. 154(b) by 221 days.

(21) Appl. No.: 11/688,258

(22) Filed: Mar. 20, 2007

(65) Prior Publication Data

US 2008/0115940 A1 May 22, 2008

Related U.S. Application Data

(60) Provisional application No. 60/859,925, filed on Nov. 20, 2006.

(51) Int. Cl.
*E21B 7/06* (2006.01)
*E21B 7/08* (2006.01)

(52) U.S. Cl. ..... 175/61; 175/62; 175/81; 166/117.5; 166/55.1; 166/50; 166/298

(58) Field of Classification Search ..... 166/117.5, 166/117.6, 50, 55.1, 298; 175/81, 61, 62, 175/320

See application file for complete search history.

(56) References Cited

U.S. PATENT DOCUMENTS

| | | | | |
|---|---|---|---|---|
| 5,392,858 | A | 2/1995 | Peters et al. | |
| 5,439,066 | A | 8/1995 | Gipson | |
| 6,220,372 | B1 | 4/2001 | Cherry | |
| 6,276,453 | B1 * | 8/2001 | Bond | 166/313 |
| 6,964,303 | B2 * | 11/2005 | Mazorow et al. | 166/298 |

* cited by examiner

*Primary Examiner*—David J Bagnell
*Assistant Examiner*—Brad Harcourt
(74) *Attorney, Agent, or Firm*—McGarry Bair PC

(57) ABSTRACT

The present application is directed to an apparatus for forming one or more holes in a wellbore casing, the apparatus comprising a deflector assembly and a drive assembly to drive said deflector assembly, wherein the deflector assembly may be optionally assembled at a surface of the wellbore prior to casing hole formation, and to methods employing the apparatus.

15 Claims, 7 Drawing Sheets

APPARATUS, SYSTEM, AND METHOD FOR CASING HOLE FORMATION IN RADIAL DRILLING OPERATIONS

CROSS-REFERENCE TO RELATED APPLICATIONS

The application is entitled to the benefit of the filing date of the prior-filed provisional application No. 60/859,925, filed on Nov. 20, 2006.

STATEMENT REGARDING FEDERALLY SPONSORED RESEARCH OR DEVELOPMENT

Not applicable.

FIELD OF THE APPLICATION

This application relates generally to casing hole formation and radial borehole formation in drilling operations.

BACKGROUND

Once a main wellbore has been drilled and cased in a geological formation, it may be desirable to form radial boreholes out from the main wellbore to increase the ultimate recovery of reserves. To accomplish this, holes are typically first formed in the casing wall to provide access for borehole forming equipment to enter the surrounding formation to form radial boreholes.

In common practice, initial casing hole formation includes running a cutting apparatus into a main wellbore to a point where a deflector device in the main wellbore operates to guide the cutting apparatus toward the inner wall of the casing to form a hole in the casing wall. Once a hole has been formed, the cutting apparatus can be removed from the main wellbore and replaced with borehole forming equipment to form a radial borehole in the surrounding formation beyond the casing hole.

Unfortunately, a cutting apparatus may be poorly stabilized during casing hole formation if the cutting apparatus is not properly oriented along the deflector device as the cutting apparatus is run into the main wellbore. For example, as the cutting apparatus is run into the main wellbore, the cutting apparatus may not successfully follow the guide path of the deflector device, leading to instability of the cutting apparatus during operation, thus, requiring additional time to form the casing hole. In particular, the configuration of a given deflector device may demand a departure of the cutting apparatus from vertical up to about 90° or more toward the inner wall of the casing. Depending on the size of the cutting apparatus and the configuration of the deflector device, the inner diameter of the casing may demand too great a turning radius for a particular cutting apparatus in relation to a particular deflector device, thereby limiting the minimum inner diameter of casing to which a particular cutting apparatus can be applied. Furthermore, known cutting apparatuses may be susceptible to getting hung up in the main wellbore prior to reaching the deflector device altogether.

The present apparatus, system and method address the deficiencies of the prior art.

SUMMARY

The present application relates to an apparatus for forming one or more holes in a wellbore casing of a main wellbore. According to the invention, the apparatus comprises a deflector assembly including a deflector and a retrievable assembly assembled therewith. The retrievable assembly comprises a cutting apparatus, a bushing on the cutting apparatus, a drive assembly comprising a bushing connector that is adapted to non-rotatably couple with the bushing by axial movement between the bushing connector and the bushing so that the drive assembly can drive the cutting apparatus, and a locking mechanism between the bushing connector and the bushing to lock the bushing connector and bushing as the bushing connector and the bushing are coupled by axial movement for retrieving the cutting apparatus from the wellbore casing. The drive assembly and the retrievable assembly are operationally configured to couple the drive assembly to the cutting apparatus in the borehole and drive the cutting apparatus to form one or more holes in the wellbore casing. In addition, the drive assembly and the retrievable assembly are operationally configured to withdraw the retrievable assembly from the deflector subsequent to forming one or more holes in the wellbore casing.

In one embodiment, the drive assembly comprises a motor, and the bushing connector comprises a drive of the motor.

In another embodiment, the locking mechanism comprises at least one locking pin that locks the bushing connector to the bushing.

In yet another embodiment, the cutting apparatus includes a drive shaft. Preferably, the cutting apparatus includes a cutting member attached to the drive shaft. In addition, the deflector can be configured to house the cutting apparatus. In addition, the cutting apparatus can be configured to be assembled into the deflector assembly at the surface of the main wellbore.

Further according to the invention, an apparatus for forming one or more holes in a wellbore casing comprises a drive shaft with a cutting member attached thereto at one end; a deflector with a channel disposed therethrough, wherein the channel is configured to receive the drive shaft and cutting member; and a drive assembly that is operationally configured to connect to an end of the drive shaft opposite the cutting member while in the wellbore casing. The drive assembly and the cutting member are operationally configured to be jointly retrievable from the deflector while the deflector remains in the wellbore casing.

Still further according to the invention, a system for forming one or more casing holes in a wellbore casing and one or more radial boreholes in the surrounding formation beyond the one or more casing holes comprises an apparatus for forming casing holes comprising: a drive shaft with a cutting member attached thereto at one end; a deflector with a channel disposed therethrough and configured to receive the drive shaft and cutting member; and a drive assembly that is operationally configured to connect to an end of the drive shaft opposite the cutting member while in the wellbore casing; and borehole forming equipment for forming radial boreholes through the casing holes. The drive assembly and the cutting member are operationally configured to be jointly retrievable from the deflector while said deflector remains in the wellbore casing.

Still further according to the invention, a method for stabilizing a cutting apparatus during casing hole formation comprises assembling the cutting apparatus with a deflector at the earth surface of a main wellbore having a casing and defining a wellbore axis to form a cutting apparatus/deflector assembly; running the cutting apparatus/deflector assembly into the main wellbore; running a drive assembly into the main wellbore; coupling the drive assembly to the cutting apparatus in the main wellbore; and driving the cutting apparatus to form one or more holes in the casing.

In one embodiment, the cutting apparatus is assembled into a channel of the deflector through one of an inlet of the channel and an outlet of the channel. The channel can depart from the wellbore axis from about 45° to about 150°. In a preferred embodiment, the channel comprises a departure from the wellbore axis of about 90°.

Still further according to the invention, a method for forming boreholes in a producing formation wherein a main wellbore has a casing extending from the earth surface into the producing formation, and the method comprises placing a retrievable assembly into a deflector assembly at the earth surface; running the deflector assembly with the retrievable assembly into the main wellbore; running a drive assembly from the earth surface into the main wellbore to drive the retrievable assembly to form one or more holes in the casing; withdrawing from the main wellbore the drive assembly and retrievable assembly attached thereto while the deflector assembly remains in the wellbore; and running borehole forming equipment into the main wellbore through the deflector assembly through the one or more holes to form boreholes into the producing formation.

DESCRIPTION

Figure 1:
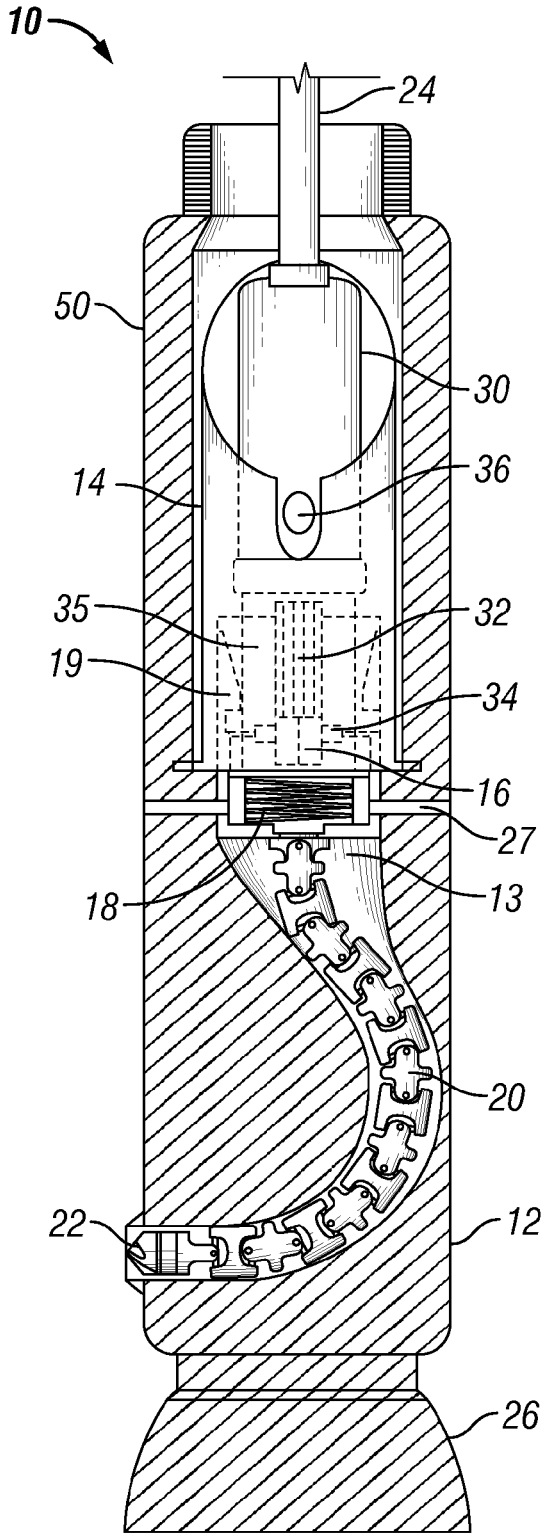
FIG. 1 illustrates a side view of one embodiment of the apparatus in an operable position within a main wellbore.

It has been found that a cutting apparatus can be: (1) assembled with a deflector device at the surface of a cased main wellbore; (2) the assembly can be run into the main wellbore; (3) a motor can be run into the main wellbore to drive the cutting apparatus to form one or more holes in the wellbore casing; (4) the motor can withdraw the cutting apparatus from the deflector device to the surface leaving the deflector device within the main wellbore; and (5) radial borehole forming equipment can then be run into the main wellbore wherein the deflector device operates to guide the radial borehole forming equipment beyond the casing holes into the surrounding formation to form radial boreholes. Heretofore, such a desirable achievement has not been suitably accomplished. Accordingly, the novel apparatus, system and method of this application measure up to the dignity of patentability and therefore represent a patentable concept.

Before describing the invention in detail, it is to be understood that the present apparatus, system and method are not limited to particular embodiments. It is also to be understood that the terminology used herein is for the purpose of describing particular embodiments only, and is not intended to be limiting. The phrase "cutting apparatus" herein may be used to refer to casing hole forming equipment such as a drive shaft and a cutting member operationally combined to form windows or holes in a wellbore casing regardless of whether the window or hole is formed by milling, drilling, cutting, heat, and the like. As used in this specification and the appended claims, directional terms, such as "upper" and "lower" are merely used for convenience in referring to the accompanying drawings. The term "upper" usually means near the part of an object more near to the earth's surface along a main wellbore. The term "lower" will usually mean near the part of an object more removed from the earth's surface. The phrase "downhole" usually means below the surface or within the main wellbore, regardless of the direction of the main wellbore. Additionally, it is to be understood that the various embodiments of the present application can be utilized in various orientations, such as inclined, inverted, horizontal, vertical, etc., and various configurations, without departing from the principles of the present apparatus, system and method.

In one aspect, the present application provides an apparatus, system and method for forming one or more holes in a main wellbore casing, including wellbore casing at high inclination angles including horizontal to the surface, and forming holes in the wellbore casing at depths greater than currently known.

In another aspect, the present application provides an apparatus, system and method for forming one or more holes in a main wellbore casing and for forming one or more radial boreholes into the surrounding formation through the casing holes.

In another aspect, the present application provides an apparatus, system and method (1) for forming one or more holes in a main wellbore casing and (2) for forming one or more radial boreholes into the surrounding formation through the casing holes along one or more azimuthal strikes.

In another aspect, the present application provides an apparatus, system and method for delivering casing hole forming equipment and radial borehole forming equipment into a main wellbore in sequential fashion to form one or more holes in a main wellbore casing followed by forming radial boreholes in the surrounding formation beyond the one or more casing holes.

In another aspect, the present application provides a method for assembling a cutting apparatus into a deflector device at the surface prior to delivering the cutting apparatus into a main wellbore.

In another aspect, the present application provides an apparatus, system and method for forming one or more holes in a main wellbore casing without restriction or limitation in regard to the inner diameter of the wellbore casing in relation to the bending angle of the cutting apparatus—allowing a particular cutting apparatus to be used in a smaller inner diameter wellbore casing than previously known.

In another aspect, the present application provides an apparatus, system and method for stabilizing a cutting apparatus within a deflector device at the surface of a main wellbore prior to casing hole formation.

In another aspect, the present application provides an apparatus, system and method for minimizing the inner diameter of a channel through a deflector device in relation to the outer diameter of a particular cutting apparatus to be set within the channel.

The various characteristics described above, as well as other features, will now be described with reference to the accompanying drawings, wherein like reference numerals are used for like features throughout the several views. It is to be fully recognized that the different teachings of the embodiments disclosed herein may be employed separately or in any suitable combination to produce desired results.

BRIEF DESCRIPTION OF THE APPARATUS

Referring now to FIG. 1, an apparatus 10 is shown that embodies some of the characteristics discussed above. Particular to this embodiment, the apparatus 10 includes a deflector 12, an orientation sub 14, a bushing 16, a spring 18, a shroud 19, a drive shaft 20, cutting member 22, motor 30, drive 32, locking pin 34, locking pin shroud 35 and alignment lug 36. In another embodiment of the apparatus 10, it is contemplated that the orientation sub 14 and the alignment lug 36 can be excluded altogether in situations where a particular alignment of the apparatus 10 in the main wellbore is not a concern.

As used herein, the above described deflector 12, orientation sub 14, bushing 16, spring 18, drive shaft 20, and cutting member 22 are sometimes, but not always, referred to collectively as a "deflector assembly". The tubing 24, motor 30, drive 32, locking pin 34, locking pin shroud 35, and alignment lug 36 are sometimes, but not always, collectively referred to as a "drive assembly". In addition, the bushing 16, spring 18, drive shaft 20, and cutting member 22 may also be collectively referred to sometimes herein as a "retrievable assembly". However, it is not intended that any of the terms "drive assembly," "deflector assembly," or "retrievable assembly" necessarily be limited to requiring each of the noted subcomponents. Various components may be used, as will be understood by those in the industry, to accomplish a "drive assembly," "deflector assembly," or "retrievable assembly."

In basic operation, the deflector assembly (which may include the retrievable assembly) may be assembled at the surface and then set at a desired depth downhole. The drive assembly can then be run downhole to a mating position with the deflector assembly, where the drive assembly is operationally configured to drive the deflector assembly, or the retrievable assembly, to form one or more holes in the wellbore casing. Following casing hole formation, the drive assembly, including the retrievable assembly attached thereto, may be withdrawn from the main wellbore as the remaining components of the deflector assembly, namely at least the deflector 12, remain in the main wellbore for future casing hole formation and/or radial borehole formation.

For the purposes of this application, it should be understood that various components of the apparatus 10 can be grouped under more than one assembly, and various referenced components can be excluded from the apparatus 10 altogether. While the present apparatus, system and method will be described with reference to the non-limiting exemplary TABLE 1 below, alternative assemblies are described later in the application. It should be noted that sub-parts may be excludable and not necessary for operation of any particular assembly. Under no circumstances is it the intent of this application to limit the terms "deflector assembly," "retrievable assembly," or "drive assembly" to requiring the specific parts listed as examples.

TABLE 1

| Assembly | Parts |
|---|---|
| Deflector Assembly | Deflector |
| | Orientation Sub |
| | Retrievable Assembly |
| Retrievable Assembly | Bushing |
| | Spring |
| | Shroud |
| | Drive Shaft |
| | Cutting Member |
| | First Spacer |
| | Second Spacer |
| Drive Assembly | Motor |
| | Drive |
| | Locking Pins |
| | Locking Pin Shroud |
| | Alignment Lug |

Figure 2:
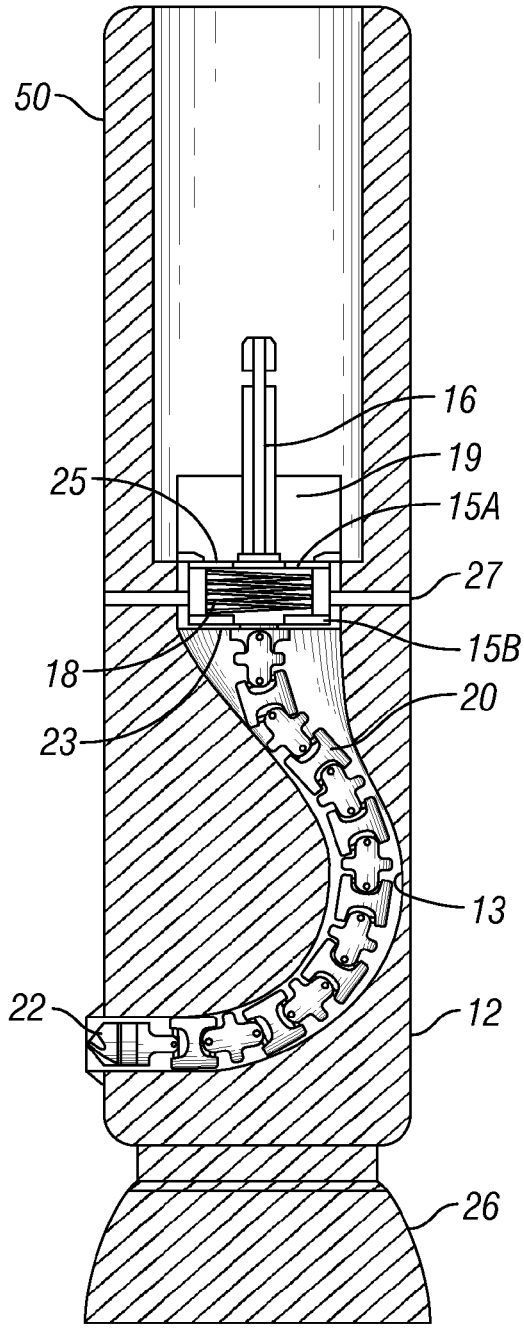
FIG. 2 illustrates a cross-sectional side view of one embodiment of the deflector assembly including a male bushing.

To better illustrate various suitable components of the deflector assembly, an embodiment of the deflector assembly without an orientation sub 14 is provided in FIG. 2. As FIG. 2 illustrates, the deflector assembly can be either releasably attached or fixed to the bottom of either a work string 50, a tubing anchor 26, or other device downhole. In one particularly advantageous embodiment, the bottom of the deflector assembly is threadably mounted to the work string 50, tubing anchor 26 or other device. In another particularly advantageous embodiment, the bottom of the deflector assembly is attached to the work string 50, tubing anchor 26 or other device via one or more, connector means, suitably set screws.

As further illustrated in FIG. 2, the deflector 12 suitably includes a channel 13 therethrough, the channel 13 having an inlet atop the deflector 12 and an outlet adjacent the inner wall of the casing. As shown, the channel 13 is suitably configured to receive and house the cutting member 22 and at least part of the drive shaft 20 during casing hole formation. In one embodiment, the top end of the drive shaft 20 can be configured to attach to the bottom of the bushing 16 (which is suitably a male Kelly bushing), and the bottom end of the drive shaft 20 can be configured to attach to the cutting member 22, which itself can be configured to extend out beyond the channel 13 outlet to a point abutting the inner wall of the main wellbore casing to form a hole in the main wellbore casing. In an alternative embodiment, the top end of the drive shaft 20 can be configured to attach to the bottom of a drive 32, which is suitably a Kelly drive and may have either a male or female orientation.

Depending on the application, the drive shaft 20 can attach to the bottom of the bushing 16 or drive 32 via a variety of attachment means. In one embodiment, the attachment means includes, for example, one or more locking pins and latches. In a particularly advantageous embodiment, the drive shaft 20 attaches to the bottom of the bushing 16 via one or more locking pins. As particularly illustrated in FIG. 3, the point of attachment between the drive shaft 20 and the bushing 16 can lie between a first spacer 15A and a second spacer 15B (also referred to herein as a first bearing and a second bearing, respectively) that are operationally configured to sandwich and compress a spring 18 therebetween. Suitably, each spacer 15A and 15B includes an opening that is configured to receive at least part of the drive shaft 20 and/or at least part of the bushing 16 therethrough. In a resting position of the attachment means, as provided in FIG. 3, part of the drive shaft 20 can extend through the opening of the second spacer 15B toward first spacer 15A and part of the bushing 16 can extend through the opening of the first spacer 15A toward the second spacer 15B, wherein the drive shaft 20 and bushing 16 can operably attach at a point within the spring 18.

In this embodiment, the spring 18 is operationally configured to dictate the amount of force applied to both the drive shaft 20 and the cutting member 22 for desired casing hole formation. Depending on the type of spring used, the weight of the drive assembly atop the first spacer 15A may be operable to compress the spring 18. The "spring" may be any variety of device or construction suitable to be selectively expanded or compressed in accordance with the forces acting thereon. In another embodiment, additional force from the surface may be applied to the topside of the first spacer 15A to compress the spring 18. Suitably, the downward movement of the drive assembly against the first spacer 15A (i.e., the compression of the spring 18) is operable to force the drive shaft 20 downward, which further forces the cutting member 22 against the inner wall of the casing for desired casing hole formation.

Figure 3:
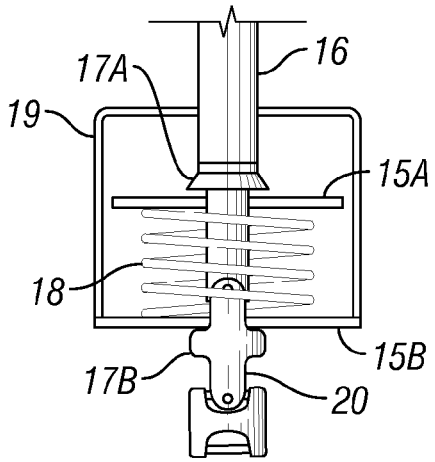
FIG. 3 illustrates a side view including one embodiment of the attachment between the drive shaft and the bushing.

As illustrated in FIG. 3, one suitable mode of compression of the spring 18 may include incorporating into the bushing 16 a shoulder 17A that comprises a width greater than the width of the opening of the first spacer 15A. Similarly, the upper portion of the drive shaft 20 may include a shoulder 17B that comprises a width greater than the width of the opening of the second spacer 15B. During operation of the apparatus 10, the shoulder 17A of the bushing 16 is configured to apply pressure to the topside of the first spacer 15A, thereby forcing the first spacer 15A toward the second spacer 15B compressing the spring 18 therebetween. Pressure from the spring 18 suitably forces the second space 15B toward the shoulder 17B, which in turn forces the cutting member 22 against the inner wall of the casing during casing hole formation. As shown in FIG. 3, second spacer 15B is operationally configured to move away from the shroud 19, but not through the shroud 19. Optionally, the second spacer 15B can be configured to move upward, wherein the shoulder 17B may be configured to apply pressure to the bottom side of the second spacer 15B, thereby forcing the second spacer 15B toward the first spacer 15A compressing the spring 18 therebetween.

Suitable springs 18 include but are not limited to, for example, coil springs and helical springs. In a particularly advantageous embodiment, the spring 18 includes a coil spring that is made from one or more materials that do not readily lose their form, including for example, high-carbon steels, alloy steels, stainless steels, copper-base alloys, nickel-base alloys, and combinations thereof.

With further reference to FIG. 2, the deflector assembly of the apparatus 10 may further include a shroud 19 (suitably a Kelly shroud) operationally configured to protect the first spacer 15A, second spacer 15B, spring 18, at least part of the bushing 16, and at least part of the drive shaft 20 from foreign substances and any unwanted physical contact from outside forces. In one embodiment, as shown in FIG. 2, the shroud 19 may abut the topside of the first spacer 15A. In another embodiment, as shown in FIG. 3, the shroud 19 may abut the topside of the second spacer 15B. Regardless of the shroud 19 configuration, as the drive shaft 20 is directed toward the surface, the shoulder 17B of drive shaft 20 may suitably be configured to contact the bottom side of second spacer 15B thereby forcing the shroud 19 toward the surface along with the drive shaft 20, second spacer 15B, and spring 18.

Figure 7A:
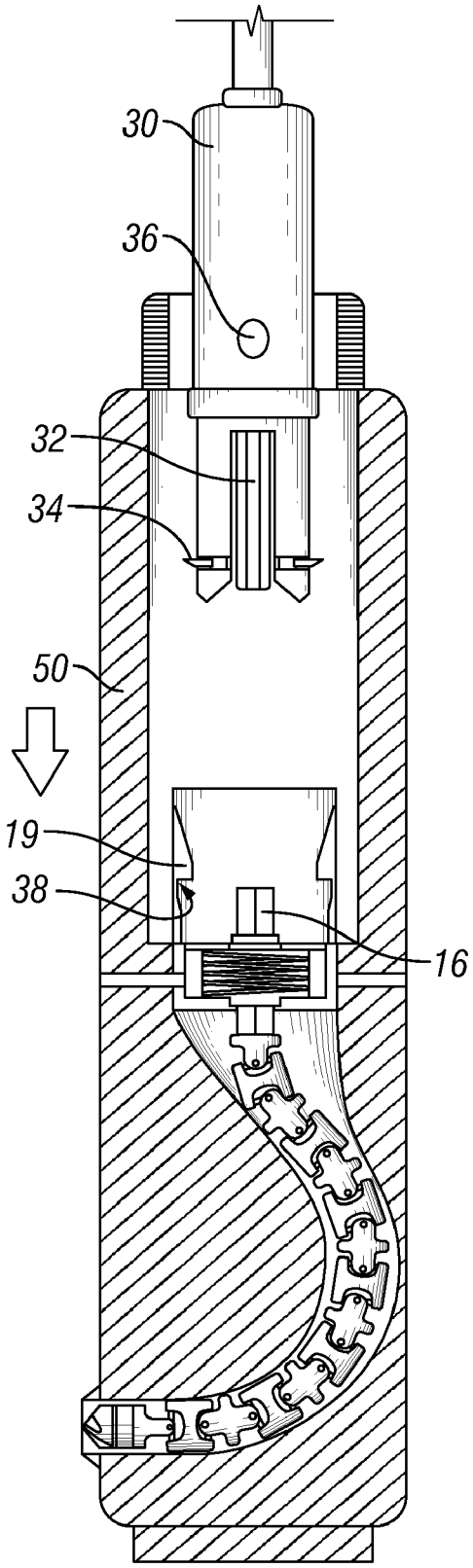
FIG. 7A illustrates a side view of one embodiment of the apparatus as the drive assembly approaches the deflector assembly in a main wellbore.
Figure 7B:
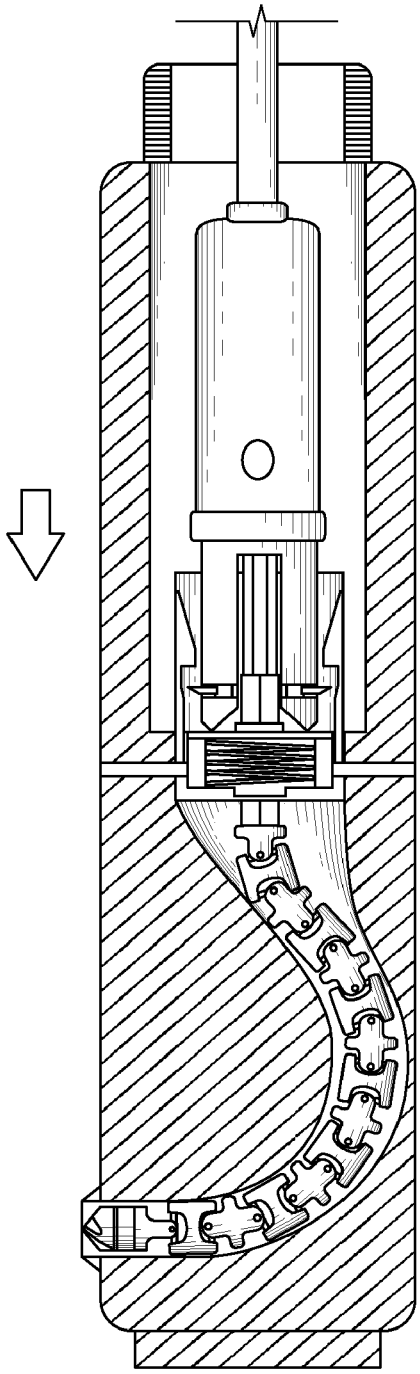
FIG. 7B illustrates a side view of one embodiment of the apparatus as the drive assembly lands against the deflector assembly.

A preferred shroud 19 may comprise any operable configuration. In one embodiment, the shroud 19 may comprise a cylindrical inner and outer shape. In another embodiment, the shroud 19 may include an inner and outer multi-sided configuration (i.e., rectangular, hexagonal, polygonal, etc.). In a particularly advantageous embodiment including a cylindrical shroud 19, the inner diameter of the shroud 19 is greater than both (1) the outer diameter of the spring 18 and (2) the outer diameter of the locking pin shroud 35 discussed in greater detail below. Optionally, the shroud 19 may comprise a height greater than, less than, or equal to the height of the corresponding bushing 16. In an embodiment where the deflector assembly comprises a drive 32 in place of a bushing 16 (as described in Example 2 below), the shroud 19 may comprise a height greater than, less than, or equal to the height of the corresponding drive 32. An embodiment including a shroud 19 comprising a height less than the height of the corresponding bushing 16 is illustrated in FIG. 2. An embodiment including a shroud 19 comprising a height greater than the height of the corresponding bushing 16 is illustrated in FIG. 7A.

The deflector assembly may further include a shear type screw 27, or other connecting means, that is operationally configured to connect the shroud 19 to the deflector 12. This connection is effective to prevent any unwanted movement of the drive shaft 20, bushing 16, shroud 19, spacers 15A, 15B and the spring 18 from external forces as the deflector assembly is run into the main wellbore. Once the drive assembly is mated with the deflector assembly (i.e., once the bushing 16 is mated with the drive 32), a suitable amount of force can be exerted upon the apparatus 10 from the surface of the main wellbore to shear the screw 27, thereby disconnecting the shroud 19 from the deflector 12 and allowing the retrievable assembly to be withdrawn from the remaining deflector assembly components as desired.

Figure 4A:
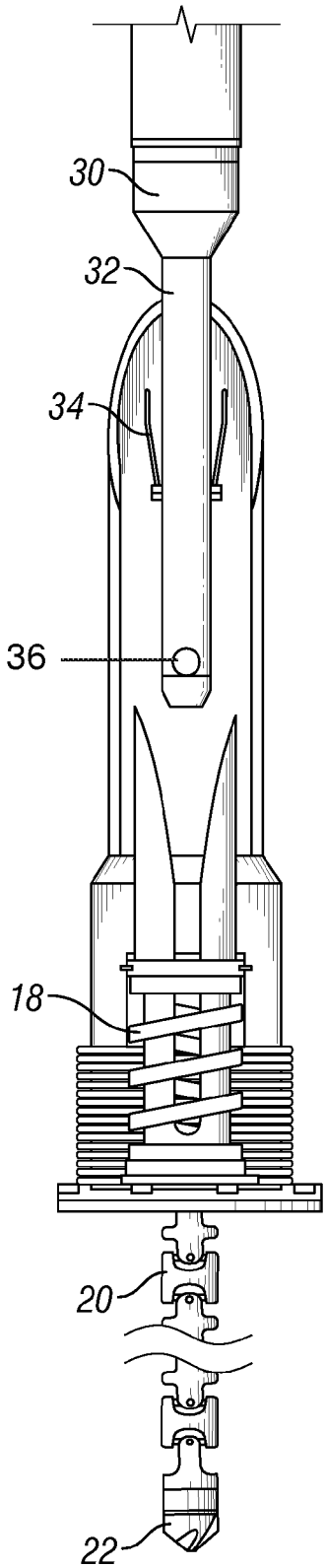
FIG. 4A illustrates a side view of another embodiment of the apparatus.
Figure 4B:
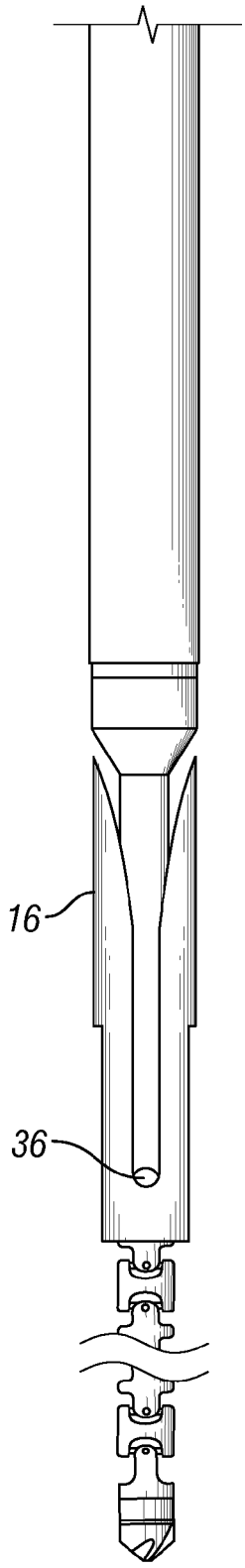
FIG. 4B illustrates a side view including one embodiment of a drive mated with a bushing.

In another embodiment of the apparatus 10 as provided in FIGS. 4A and 4B, the retrievable assembly is configured to comprise only the bushing 16, the drive shaft 20 and the cutting member 22. In this embodiment, any spacers 15A, 15B and/or spring 18 to be included as part of the apparatus 10 make up part of the deflector assembly wherein the components 15A, 15B and 18 are operationally configured to remain fixed to the deflector assembly (i.e., remain fixed to the top of the deflector 12) as the retrievable assembly is withdrawn from the deflector assembly. Here, the drive shaft 20 suitably attaches to the bushing 16, as discussed earlier in the application. However, in this embodiment, the drive shaft 20 does not include a shoulder 17B or equivalent appendage and the drive shaft 20 is therefore operationally configured to be withdrawn from the deflector assembly through the openings of the spacers 15A, 15B and spring 18.

As shown in FIG. 4A, the motor 30 and drive 32 can be run downhole until the drive 32 reaches a mating position with the bushing 16. Once mated, the motor 30 operates to rotate the drive shaft 20 to direct the cutting member 22 to form a hole in the casing wall. During casing hole formation, a first spacer 15A can be directed toward the second spacer 15B thereby compressing the spring 18 therebetween, as discussed previously. Unique to this embodiment however, is the means of attachment between the drive assembly and the retrievable assembly. In this embodiment, the locking pins 34 may include spring loaded bow locks that are operationally configured to releasably attach the motor 30 and drive 32 ("drive assembly") to the bushing 16, drive shaft 20 and cutting member 22 ("retrievable assembly"). Here, when the drive assembly is withdrawn, the bushing 16, drive shaft 20 and cutting member 22 can be withdrawn with the drive assembly.

Once the retrievable assembly has been removed from the deflector assembly, the channel 13 of the deflector 12 is left unobstructed and is operationally configured to receive borehole forming equipment therethrough to a point beyond the casing hole to form a borehole in the surrounding formation.

With further reference to FIG. 4A, bow locks 34 (preferably spring loaded) may suitably attach to the outer wall of the drive 32, thus eliminating the need for a locking pin shroud 35. Suitably, the bow locks 34 are configured to expand and catch in a groove disposed along the inner wall of the bushing 16—thereby locking the drive 32 to the bushing 16, drive shaft 20 and cutting member 22 (i.e., locking the drive assembly to the bushing 16 and the retrievable assembly) (see FIG. 4B). In still another embodiment, the locking pins 34 can be excluded altogether, allowing the drive assembly (i.e., the motor 30 and the drive 32) to be withdrawn from the main wellbore alone following casing hole formation. In this embodiment, a drive assembly including suitable connecting means, including but not limited to spring loaded bow locks 34, can be reintroduced into the main wellbore to withdraw the retrievable assembly, or in the alternative, the retrievable assembly can be removed by other fishing means known in the art prior to radial borehole formation.

Suitably, a deflector assembly, including at least some of the components listed in Table 1, may be assembled at the well head surface wherein the cutting apparatus may be manually placed within the channel 13 of the deflector 12. Manual placement of the cutting apparatus within the channel 13 at the surface is sometimes desired because it can allow a user to manipulate a particular cutting apparatus into a channel 13 that has both a greater reduced radius (i.e., a greater channel bend) and a smaller inner diameter than can be accomplished when attempting to run the same cutting apparatus into the same channel 13 from the surface of the main wellbore. In addition, manual placement of the cutting apparatus within the channel 13 of the deflector 12 allows for optimal stabilization of the cutting apparatus during casing hole formation. Herein, optimal stabilization can be achieved by minimizing the difference between the outer diameter of the cutting apparatus and the inner diameter of the channel 13 so that at least part of the cutting apparatus lies flush against the inner wall of the channel 13 during casing hole formation.

Figure 5:
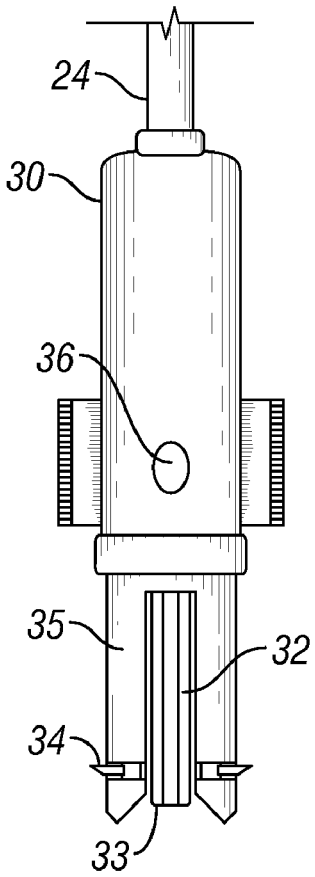
FIG. 5 illustrates a side view of one embodiment of the drive assembly.

With reference now to an illustration of the drive assembly as provided in FIG. 5, the drive assembly can include, for example, a motor 30, alignment lug 36, one or more locking pins 34, a drive 32 and a locking pin shroud 35 as listed in Table 1. Suitably, the top end of the motor 30 can be configured to releasably or fixedly attach to a tubing 24 and the bottom end of the motor 30 can be configured to releasably or fixedly attach to the drive 32 and the locking pin shroud 35. In this embodiment, the one or more locking pins 34 are suitably housed within the sidewall of the locking pin shroud 35 as shown. In one embodiment, the one or more locking pins 34 may be spring loaded and operationally configured to extend out from the locking pin shroud 35 to a mating position with either an aperture or grooved slot 38 located on the bushing shroud 19, as shown in FIG. 7A, or by other equivalent connectors. In another embodiment, the one or more locking pins 34 can be manually operated from the surface for mating with the aperture or grooved slot 38.

As stated previously, the locking pin shroud 35 suitably includes an outer diameter less than the inner diameter of the shroud 19. In a particularly advantageous embodiment, the locking pin shroud 35 includes an outer diameter slightly less than the inner diameter of the shroud 19 wherein at least part of the outer wall of the locking pin shroud 35 lies flush against at least part of the inner wall of the shroud 19. Likewise, a gap between the drive 32 and the locking pin shroud 35 is configured to receive a corresponding bushing 16 up to the full depth of the gap. In a particularly advantageous embodiment as provided in FIG. 1, the depth of the gap is about equal to the length of the bushing 16, which produces a secure fit between the bushing 16, drive 32 and locking pin shroud 35 during operation of the apparatus 10. A secure fit ensures both desired operation and reduced failure of the apparatus 10 during casing hole formation. In the alternative, as provided in FIG. 4A, the locking pin shroud 35 can be omitted altogether when employing bow locks 34 that are mounted on the drive 32.

Figure 6:
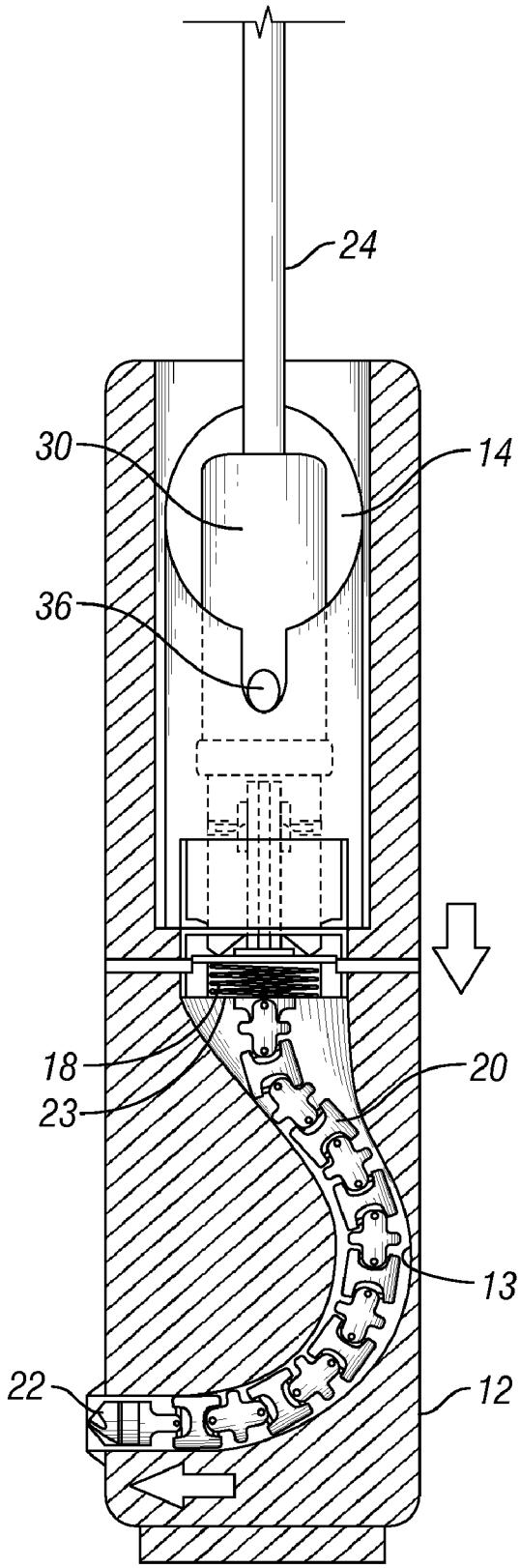
FIG. 6 illustrates a side view of one embodiment of the apparatus as the drive assembly comes to a mating position with the deflector assembly.
Figure 9:
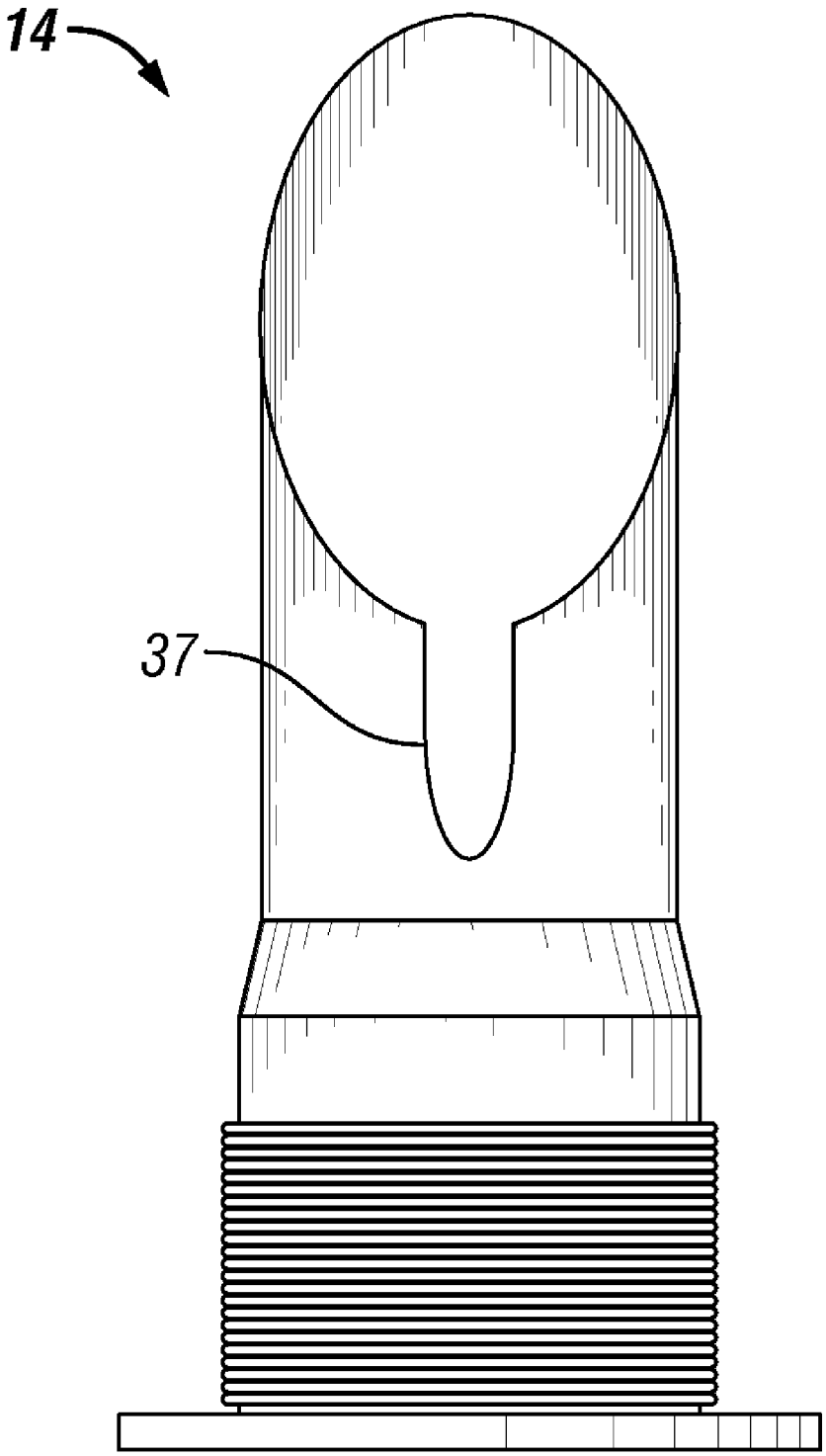
FIG. 9 illustrates a side view of an orientation sub.

With reference now to FIG. 6, the deflector assembly of the apparatus 10 can further include an orientation profile such as an orientation sub 14 that is operationally configured to align the drive assembly with the deflector assembly in a desired mating position during casing hole formation. As shown, the motor 30 suitably includes an alignment lug 36 extending out from the outer wall of the motor 30 that is operationally configured to land against the top edge of the orientation sub 14 as the drive assembly is run downhole. With particular attention to FIG. 9, the orientation sub 14 suitably comprises a top edge that tapers down to an alignment slot 37 that is configured to receive at least part of the alignment lug 36. Alignment of the lug 36 with the alignment slot 37 ensures that the drive 32 mates with the bushing 16 as desired. In a particularly advantageous embodiment, as the lug 36 travels along the top edge of the orientation sub 14 toward the alignment slot 37, the orientation sub 14 effectively guides the drive 32 (may be a male or female configuration) to a mating position with the bushing 16 (may be a male or female configuration), wherein the drive assembly operably attaches to the retrievable assembly via one or more locking pins 34.

Although various embodiments of the orientation sub 14 are herein contemplated, a particularly advantageous orientation sub 14 includes a cylindrical shape having an inner diameter greater than the outer diameter of the motor 30. Although not necessarily limited to any particular material, a suitable orientation sub 14 is made from one or more materials durable enough to withstand the weight of the alignment lug 36 without deforming—and causing operable failure of the apparatus 10.

In an alternative embodiment of the apparatus 10, an orientation profile can be located along the top edge of the bushing 16 itself—as shown in FIG. 4B. In this embodiment, the corresponding drive 32 suitably includes a lug 36 that extends out from the outer wall of the drive 32, and the orientation profile of the bushing 16 suitably includes an alignment slot 37 operationally configured to receive the alignment lug 36 for desired mating between the deflector assembly and the drive assembly. In this embodiment, as the lug 36 travels along the tapered top edge of the bushing 16 toward the alignment slot 37, the bushing 16 effectively guides the drive 32 to a mating position with the bushing 16.

In each of the embodiments of apparatus 10 herein contemplated, the alignment lug 36 suitably comprises a height necessary to land on at least part of the top edge of the orientation sub 14 and alignment slot 37. As is necessarily illustrated in the Figures, the maximum height of the alignment lug 36 is only limited by the inner diameter of the wellbore casing.

BRIEF DESCRIPTION OF THE OPERATION OF THE APPARATUS

In a simplified example of operation of the apparatus 10, a tubing anchor 26 can be fixed to a work string downhole. A deflector assembly can then be run downhole wherein the deflector assembly is operationally configured to releasably attach to the top of the tubing anchor 26. Once the deflector assembly is attached to the tubing anchor 26, a drive assembly attached to a tubing 24 can be run downhole wherein the drive assembly is operationally configured to mate with the deflector assembly and operationally configured to direct the deflector assembly to form one or more holes in the main wellbore casing.

Where the apparatus 10 incorporates an alignment slot 37 and a lug 36 as described above, the downhole orientation of the channel 13 outlet can be determined by fixing the alignment slot 37 along the deflector assembly to a predetermined setting in relation to the channel outlet. Thus, as a drive assembly is run downhole, a user at the surface can determine the given direction of the channel outlet based on the orientation of the drive assembly once mated to the deflector assembly. In other words, once a user determines the direction of the lug 36 as received by the alignment slot 37, the user can then locate a particular radial borehole previously formed out from the main wellbore, or in the alternative, the user can determine and record a desired direction for a future radial borehole. In particular detail, a gyro tool or similar device can be run into the main wellbore from the surface to locate the alignment slot 37 of the deflector assembly. Once the orientation of the alignment slot 37 is determined in relation to the main wellbore, (1) the location of existing casing holes and the direction of existing radial boreholes can be determined and recorded, and (2) the location of future casing holes and the direction for future radial boreholes out from the main wellbore can be determined.

An exemplary cycling of the apparatus 10 during casing hole formation is provided in FIGS. 7A-7E. As shown, as the drive assembly reaches a mating position with the deflector assembly, the one or more locking pins 34 of the drive assembly are operationally configured to attach the drive assembly to the retrievable assembly. In particular, as the drive assembly reaches a mating position with the deflector assembly, the drive assembly is operationally configured to compress the spring 18 downward to a point where the one or more locking pins 34 can extend out from the locking pin shroud 35 to a mating position with an aperture or grooved slot 38 along the deflector assembly, thereby locking the drive shaft 32 (shown as a male configuration) to the bushing 16 (shown as a female configuration). Both the drive shaft 32 and busing 16 may be of either male or female configuration. As discussed above, either the weight of the motor 30 alone or additional force from the surface suitably compresses the spring 18 so that a constant positive force is applied against the top of the drive shaft 20, further forcing the cutting member 22 against the inner wall of the casing for effective casing hole formation. Although not necessary for operation of the apparatus 10, a constant positive force applied to the top of the drive shaft 20 provides faster, smoother and more uniform casing hole formation than achieved when an intermittent amount of force is applied to the top of the drive shaft 20. In addition, irregularities in the amount of force being applied to the cutting member 22 during casing hole formation can result in failure of the cutting member 22 (i.e., chipping of the drill bit).

Figure 7C:
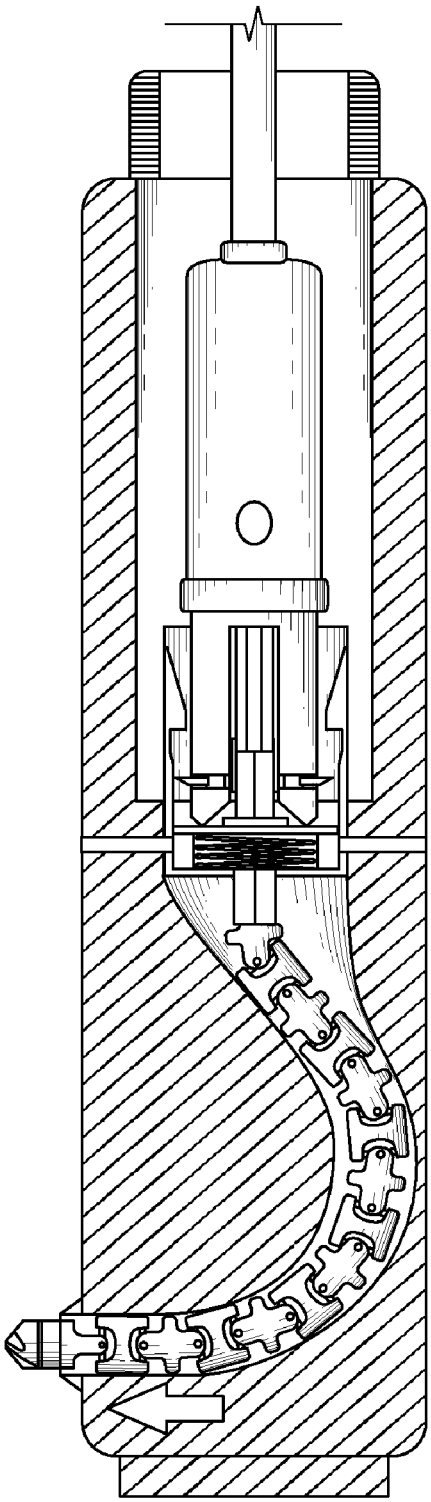
FIG. 7C illustrates a side view of one embodiment of the apparatus wherein the drive assembly compresses the spring of the deflector assembly during casing hole formation.

As shown in FIG. 7C, once the drive assembly is operationally mated with the deflector assembly, fluid can be pumped from the surface to turn the motor 30 and drive 32, which in turn drives the bushing 16, drive shaft 20 and cutting member 22 to form holes in the wellbore casing. In an embodiment of the apparatus 10 where the drive assembly includes a bushing 16 and the deflector assembly includes a drive 32 (as listed in Table 3 below), fluid pumped from the surface operates to turn the motor 30 and bushing 16, which in turn drives the drive 32, drive shaft 20, and cutting member 22 to form holes in the wellbore casing.

Figure 7D:
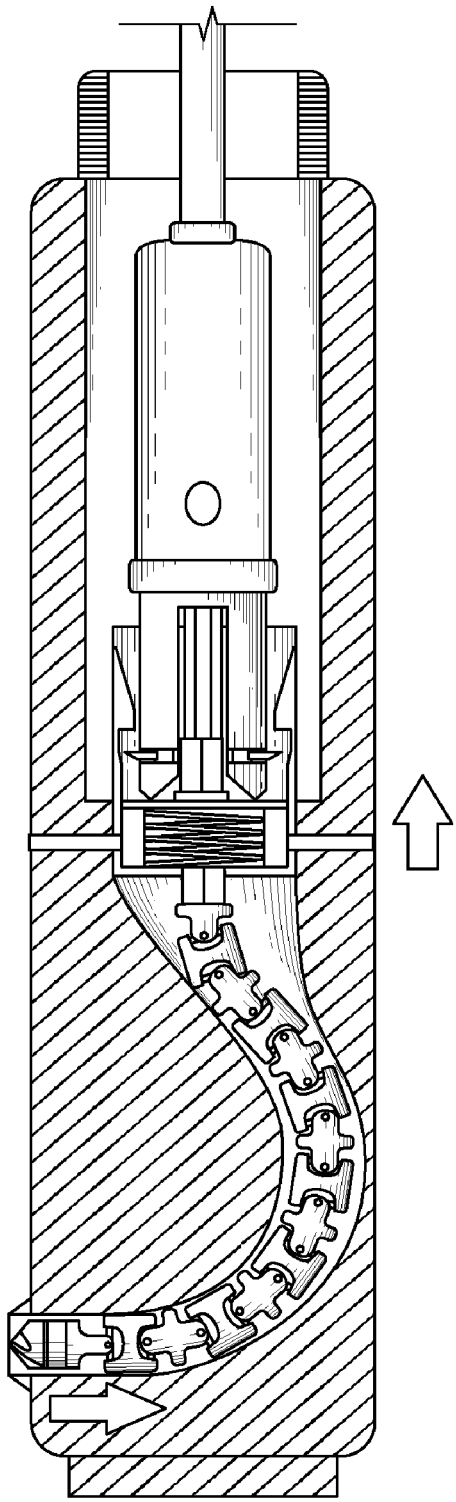
FIG. 7D illustrates a side view of one embodiment of the apparatus as the drive assembly and retrievable assembly are initially withdrawn from the main wellbore.
Figure 7E:
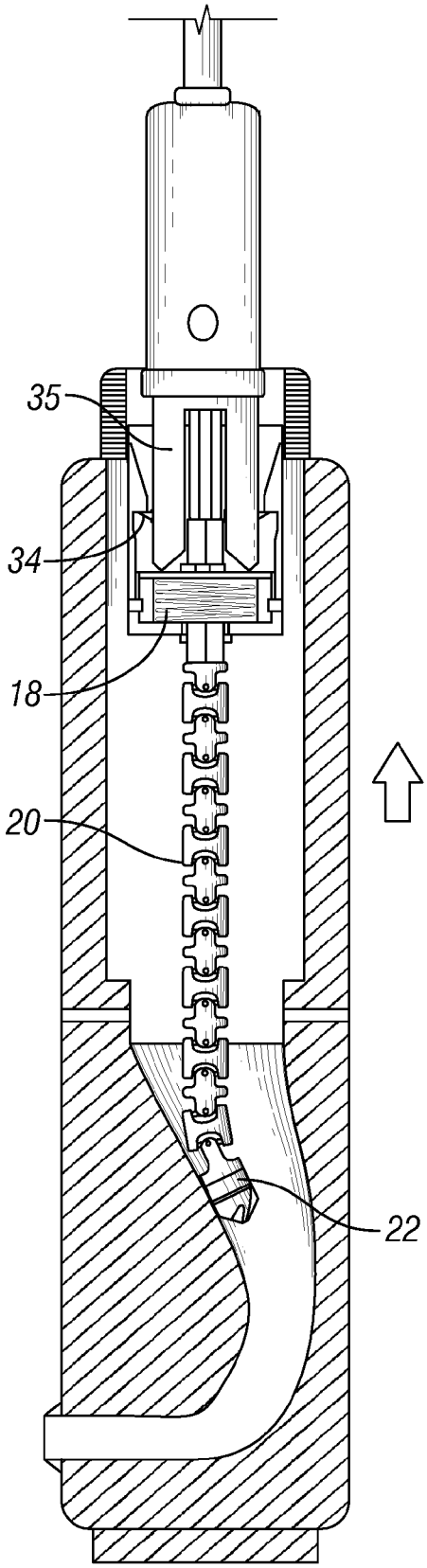
FIG. 7E illustrates a side view of one embodiment of the apparatus as the drive assembly and retrievable assembly are further withdrawn from the main wellbore.
Figure 8:
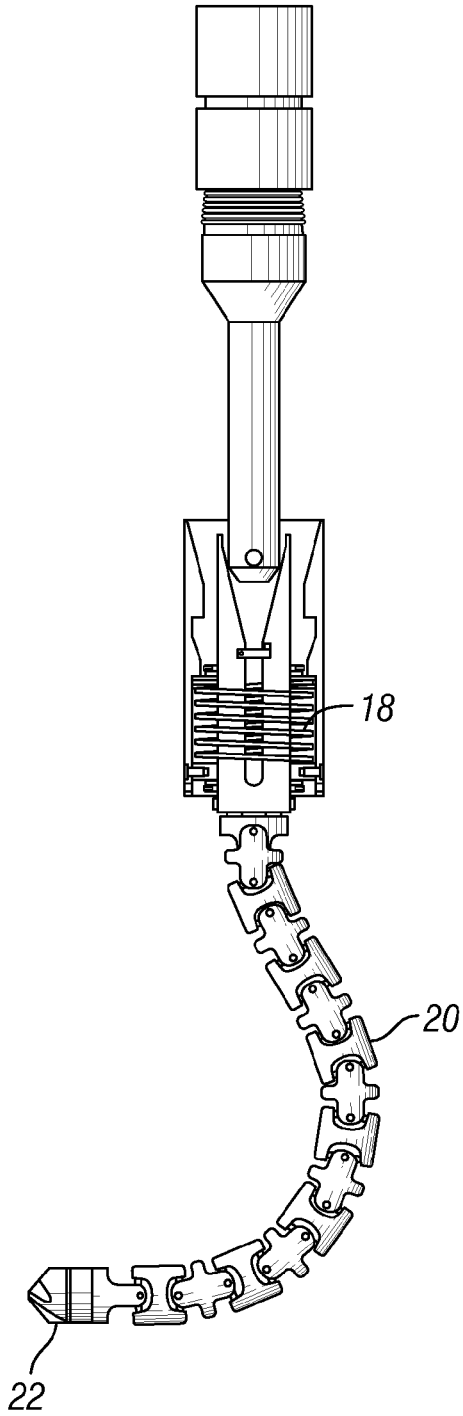
FIG. 8 illustrates a side view of the apparatus excluding a deflector.

Once a desired number of holes have been formed in the wellbore casing, the tubing 24 along with the drive assembly attached thereto can be directed toward the surface—as shown in FIGS. 7D and 7E. Suitably, as the drive assembly is being withdrawn from the main wellbore, the one or more locking pins 34 are operationally configured to catch the aperture or grooved slot 38 of the retrievable assembly thereby withdrawing a retrievable assembly out from the remaining deflector assembly (e.g., the deflector 12, and an orientation sub 14, if included). In the embodiment of the apparatus 10 as provided in FIG. 4A, spring loaded bow locks 34 are operationally configured to releasably attach the drive assembly to the retrievable assembly in order to withdraw the retrievable assembly (i.e., in this particular instance the drive shaft 20 and cutting member 22) out from the remaining deflector assembly. Once the drive assembly and the retrievable assembly have been withdrawn from the main wellbore, the deflector 12 remaining downhole is operationally configured to receive further retrievable assemblies, or radial borehole forming equipment.

For the purposes of this application, a suitable deflector 12 may include any deflector type device capable of guiding both casing hole forming equipment and radial borehole forming equipment from the main wellbore axis. Although not limited to any particular embodiment, a suitable deflector 12 comprises a solid material having a channel 13 therethrough forming an inlet at the top of the deflector 12 and an outlet along the side of the deflector 12 as previously described. Suitably, the departure of the channel 13 outlet from vertical (i.e., the departure of the outlet from the wellbore axis) is from about 45° to about 150°. In a particularly advantageous embodiment, the departure of the channel 13 outlet from vertical is true 90° horizontal.

Depending on the application, a desired downhole orientation of the channel 13 outlet may be determined at the surface prior to running the deflector assembly into the main wellbore. In another embodiment, the downhole orientation of the channel 13 outlet may be determined once the deflector assembly has been run downhole, wherein a gyro tool or similar device can be operated from the surface to orient the deflector 12 as desired.

Herein, a suitable drive shaft 20 may include, for example, a knuckle joint drive system made from materials including for example, carbon steel and high alloy steel. In another embodiment, the drive shaft 20 may include a long spring that is not limited to any particular bend requirements and is configured to maneuver the length of channel 13. In still another embodiment, the drive shaft 20 may include a flexible shaft configured to transfer torque of about 80 foot-pounds or more (about 1,106,040 gram-force centimeters or more). In addition, a suitable cutting member 22 may include, for example, any milling, cutting or drilling device (1) effective for forming a hole in a wellbore casing, and (2) configured to attach to any drive shaft 20 incorporated into the apparatus 10.

The one or more locking pins 34 and spring loaded bow locks 34 can be made from any material durable enough to effectively mate the drive assembly with the retrievable assembly. Suitable locking pin 34 and spring loaded bow lock 34 materials include, for example, plastics, composite materials and metals. Suitable metals include, for example, high carbon steel, low carbon steel, stainless steel, aluminum, aluminum alloys, iron, iron alloys, and combinations thereof.

A suitable motor 30 may include any motor common to drilling operations. Suitable motors include for example, mud motors, and turbine motors. Likewise, the bushing 16 and drive 32 may include any drive/bushing combination known to those of ordinary skill in the art that is capable of being used as part of the apparatus 10 contemplated herein.

The tubing anchor 26 described herein may include any standard tubing anchor typically used in drilling operations for preventing rotation or reciprocation of the apparatus 10 and the tubing 24 during production operations. In a particularly advantageous embodiment, the tubing 24 includes standard upset threaded tubing. In an alternative embodiment, coiled tubing ("SCT") can be used in place of the standard upset threaded tubing. Suitably, the tubing 24 is made from metal, composite material, and combinations thereof effective to convey high pressure fluid of about 10,000 psi or more (about 68,948 kPa or more) from the surface to the apparatus 10 during casing hole and borehole formation. Suitable tubing 24 metals include for example, steel, titanium, and combinations thereof.

Herein, each of the components making up the apparatus 10 may be made from materials in addition to those named above, as determined by the drilling application at hand. For example, if hydrogen sulfide is present in the drilling environment, the components making up the apparatus 10 are suitably materials resistant to the hydrogen sulfide. Additional materials for any one component include, for example, steel, steel alloys, stainless steel, stainless steel alloys, copper, copper based alloys, brass, brass based alloys, fiberglass, plastics, non-conductive materials, and combinations thereof. Depending on the application, various components may further be made from elastomers, including but not limited to, such as natural or synthetic rubber, polyurethane, flexible plastics, flexible carbon fiber, plastic composites, rubber composites, carbon composites, nylon, polytetrafluoroethylene, and acrylics. Under certain conditions, various components may also be made from polymers.

Although not limited to a particular embodiment, suitable borehole forming equipment includes, for example, standard flexible hose with a jet nozzle attached thereto. A particularly advantageous embodiment, the standard flexible hose includes a standard flexible hydraulic hose comprising at least one layer of wire braid wrapped around a rubber core—both of which are further encased by at least one rubber outer sleeve. Although the size and length of the flexible hose is ultimately determined by the application, for most drilling operations, a suitable standard flexible hose has an outer diameter up to about 2½ inches (up to about 6.35 cm). In another embodiment, the flexible hose includes an outer diameter from about ½ inch to about ¾ inches (from about 1.27 cm to about 1.90 cm). In a particularly advantageous embodiment, the flexible hose comprises an outer diameter of about ½ inch and has a substantially uniform wall thickness of about 3/16 inches (about 0.5 cm). Regardless of the outer diameter of the flexible hose, a suitable standard flexible hose is capable of bending up to about 100° from vertical (i.e., up to about 100° from the wellbore axis) through a channel 13 of the deflector 12.

The invention will be better understood with reference to the following non-limiting examples, which are illustrative only and not intended to limit the present invention to a particular embodiment.

Example 1

In one non-limiting example of the apparatus 10 disclosed herein, the components, as assembled in TABLE 1 above, comprise the approximate dimensions shown in Table 2 below:

TABLE 2

| COMPONENT | LENGTH/ HEIGHT | OUTER DIAMETER | INNER DIAMETER |
|---|---|---|---|
| Deflector | 12" | 4¾" | 1" channel |
| Orientation Sub | 9" | 2⅞" | 2⅜" |
| Bushing | 4" | 1⅜" | ¾" × ¾" square |
| Spring | 4" | 1 11/16" | 1 7/16" |
| Bushing Shroud | 5" | 2" | 1¾" |
| Driveshaft | 10" | ⅞" | N/A |
| Cutting Member | ¾" | ¾" | N/A |
| Motor | 5" | 1¾" | N/A |
| Drive | 10" | ¾" × ¾" square | N/A |
| Locking Pin | 1" | ¼" | N/A |
| Locking Pin Shroud | 6" | 1 11/16" | 1 7/16" |
| Spacer | ½" | 2 5/16" | N/A |
| Alignment Lug | 1.5" | ½" thick | — |

Example 2

In another non-limiting example of the apparatus 10 disclosed herein, the components comprising the approximate dimensions shown in TABLE 2 above, are assembled as shown in Table 3 below:

TABLE 3

| Assembly | Parts |
|---|---|
| Deflector Assembly | Deflector |
| | Orientation Sub |
| | Retrievable Assembly |
| Retrievable Assembly | Drive |
| | Spring |
| | Shroud |
| | Drive Shaft |
| | Cutting Member |
| Drive Assembly | Motor |
| | Bushing |
| | Locking Pins |
| | Locking Pin Shroud |
| | Alignment Lug |

Example 3

In another non-limiting example of the apparatus 10 as illustrated in FIGS. 4A and 4B, each of the components comprise the approximate dimensions shown in TABLE 4 below, and each of the components are assembled as shown in Table 5 below:

TABLE 4

| COMPONENT | LENGTH/HEIGHT | OUTER DIAMETER | INNER DIAMETER |
|---|---|---|---|
| Deflector | 14" | 3¾" | ⅞" channel |
| Orientation Sub | 9" | 2⅞" | 2⅜" |
| Bushing | 8" | 1⅜" | ¾" diameter |
| Spring | 4" | 1 11/16" | 1 7/16" |
| Driveshaft | 10" | ¾" | N/A |
| Cutting Member | ¾" | ¾" | N/A |
| Motor | 5" | 1¾" | N/A |
| Drive | 10" | ¾" diameter | N/A |
| Spacer | ½" | 2 5/16" | N/A |
| Alignment Lug | 1.5" | ½" thick | — |

TABLE 5

| Assembly | Parts |
|---|---|
| Deflector Assembly | Deflector |
| | Retrievable Assembly |
| | Spring |
| Retrievable Assembly | Drive Shaft |
| | Cutting Member |
| | Bushing |
| Drive Assembly | Motor |
| | Drive |
| | Spring Loaded Bow Locks |
| | Alignment Lug |

Disclosed herein in the specification of this application are each of the claims filed herewith, with all such independent and dependent claims filed being incorporated by reference as if fully set forth herein.

As will be understood by those of ordinary skill in the art, and others, many modifications may be made without departing from the spirit and scope of the invention. The embodiments described herein are meant to be illustrative only and should not be taken as limiting the invention, which is defined in the following claims.

We claim:

1. A method for stabilizing a cutting apparatus during casing hole formation, the method comprising the following steps:

assembling the cutting apparatus with a deflector at the earth surface of a main wellbore having a casing and defining a wellbore axis to form a cutting apparatus/deflector assembly;

running the cutting apparatus/deflector assembly into the main wellbore;

running a drive assembly into the main wellbore;

coupling the drive assembly to the cutting apparatus in the main wellbore; and driving the cutting apparatus to form one or more holes in the casing.

2. The method of claim 1 wherein the cutting apparatus is assembled into a channel of the deflector through one of an inlet of the channel and an outlet of the channel.

3. The method of claim 2, wherein the channel comprises a departure from the wellbore axis from about 45° to about 150°.

4. The method of claim 2, wherein the channel comprises a departure from the wellbore axis of about 90°.

5. A method for forming boreholes in a producing formation wherein a main wellbore having a casing extends from the earth surface into the producing formation, the method comprising:

placing a retrievable assembly into a deflector assembly at the earth surface;

running the deflector assembly with the retrievable assembly into the main wellbore;

running a drive assembly from the earth surface into the main wellbore to drive the retrievable assembly to form one or more holes in the casing;

withdrawing from the main wellbore the drive assembly and retrievable assembly attached thereto while the deflector assembly remains in the wellbore; and running borehole forming equipment into the main wellbore through the deflector assembly through the one or more holes to form boreholes into the producing formation.

6. An apparatus for forming one or more holes in a wellbore casing comprising:

a drive shaft with a cutting member attached thereto at one end;

a deflector with a channel disposed therethrough, said channel configured to receive the drive shaft and cutting member; and a drive assembly, said drive assembly being operationally configured to connect to an end of the drive shaft opposite the cutting member while in the wellbore casing;

wherein said drive assembly and said cutting member are operationally configured to be jointly retrievable from said deflector while said deflector remains in the wellbore casing.

7. An apparatus for forming one or more holes in a wellbore casing of a main wellbore comprising:

a deflector assembly including a deflector and a retrievable assembly assembled therewith, the retrievable assembly comprising a cutting apparatus;

a bushing on the cutting apparatus;

a drive assembly comprising a bushing connector that is adapted to non-rotatably couple with the bushing by axial movement between the bushing connector and the bushing so that the drive assembly can drive the cutting apparatus; and a locking mechanism between the bushing connector and the bushing to lock the bushing connector and bushing as the bushing connector and the bushing are coupled by axial movement for retrieving the cutting apparatus from the wellbore casing;

whereby the drive assembly and the retrievable assembly are operationally configured to couple the drive assembly to the cutting apparatus in the borehole and drive the cutting apparatus to form one or more holes in the wellbore casing and to withdraw the retrievable assembly from the deflector subsequent to forming one or more holes in the wellbore casing.

8. The apparatus of claim 7, wherein the drive assembly comprises a motor, and the bushing connector comprises a drive of the motor.

9. The apparatus of claim 7, wherein the locking mechanism comprises at least one locking pin that locks the bushing connector to the bushing.

10. The apparatus of claim 7, wherein the deflector assembly is configured to receive borehole forming equipment once the retrievable assembly has been removed from the deflector.

11. The apparatus of claim 7, wherein the cutting apparatus includes a drive shaft.

12. The apparatus of claim 11, wherein the cutting apparatus includes a cutting member attached to the drive shaft.

13. The apparatus of claim 7, wherein the deflector is configured to house the cutting apparatus.

14. The apparatus of claim 7, wherein the cutting apparatus is configured to be assembled into the deflector assembly at the surface of the main wellbore.

15. A system for forming one or more casing holes in a wellbore casing and one or more radial boreholes in the surrounding formation beyond the one or more casing holes comprising:

an apparatus for forming casing holes comprising;

a drive shaft with a cutting member attached thereto at one end;

a deflector with a channel disposed therethrough, said channel configured to receive the drive shaft and cutting member; and a drive assembly, said drive assembly being operationally configured to connect to an end of the drive shaft opposite the cutting member while in the wellbore casing; and borehole forming equipment for forming radial boreholes through the casing holes;

wherein said drive assembly and said cutting member are operationally configured to be jointly retrievable from said deflector while said deflector remains in the wellbore casing.

* * * * *